US006663009B1

(12) United States Patent
Bedetti et al.

(10) Patent No.: US 6,663,009 B1
(45) Date of Patent: Dec. 16, 2003

(54) GAS COOKER

(75) Inventors: Nicola Bedetti, Como (IT); Ermanno Buzzi, Varese (IT); Alessandra Gagliardi, Milan (IT); Gianpiero Santacatterina, Sangiano (IT); Daniele Turetta, Ispra (IT)

(73) Assignee: Whirlpool Corporation, Benton Harbor, MI (US)

( * ) Notice: Subject to any disclaimer, the term of this patent is extended or adjusted under 35 U.S.C. 154(b) by 57 days.

(21) Appl. No.: 10/144,180

(22) Filed: May 13, 2002

(30) Foreign Application Priority Data

May 14, 2001 (EP) ..... 01111650

(51) Int. Cl.[7] ..... F23N 1/08; F27D 11/00
(52) U.S. Cl. ..... 236/20 A; 126/374.1; 219/448.17
(58) Field of Search ..... 236/20 A; 219/448.13, 219/448.17; 126/374.1

(56) References Cited

U.S. PATENT DOCUMENTS 2,782,782 A * 2/1957 Taylor ..... 236/20 A
5,658,478 A * 8/1997 Roeschel et al. ..... 219/502
6,169,486 B1 * 1/2001 Berkcan et al. ..... 340/584

* cited by examiner

*Primary Examiner*—William Wayner
(74) *Attorney, Agent, or Firm*—Thomas J. Roth; Robert O. Rice; John F. Colligan

(57) ABSTRACT

A gas cooker comprises temperature detection means for detecting the temperature of the bottom face of a pan and issuing a temperature signal and an heat control circuit for controlling the amount of heat issued from the gas burner based on said temperature signal. The temperature detection means is placed in a zone of the cooker around the burner and shielding means are provided in order to reduce the influence of the burner flame on the temperature detection means.

9 Claims, 5 Drawing Sheets

GAS COOKER

BACKGROUND OF THE INVENTION

1. Field of the Invention

The present invention relates to a cooker comprising a gas burner for heating food material in a container, temperature detection means for detecting the temperature of the bottom face of the container and issuing a temperature signal, and a heat control circuit for controlling the amount of heat issued from the gas burner based on said temperature signal.

With the term "cooker" we means all kind of cooking appliances that use a gas burner for heating/cooking a food material, cook tops, ranges and cooking hobs included.

The above kind of cookers does not need the presence of the user so that he does not need to check and to control the cooking process continuously. Several functions of the cooking process, for example to detect the boiling process, to control the boiling process, to control the simmering etc., can be automatically performed in a gas cooker by measuring the bottom temperature of the container or pan.

During heating and boiling process of a liquid (water) in a pan, the thermal content of the liquid itself and of the pot varies following some physical laws which depends mainly from the following parameters: liquid quantity and type, heat supply, room conditions (temperature and pressure), pan type.

A method for monitoring the thermal content of the foodstuff is to measure the temperature of the pan. In fact, while the absolute temperature of the pan bottom/sides depends on the thermal conductance of pan material and on heat supply, the temperature gradient is strictly dependent on the liquid content in most part of the heating process.

Furthermore when water starts to fully boil, both liquid and pan temperature reach a constant value.

As a consequence the boiling process can be monitored by simply measuring the pan temperature gradient, as the output to a known heating input (burner power).

2. Description of the Related Art

EP0690659 discloses the detection of pan sidewall temperature by means of an IR sensor placed on an electric hob. This sensor can allow the user to select the desired temperature food range and to maintain it during cooking process. This solution has the drawback that a special pot with a known emissivity material coating must be used. Furthermore, on a gas cook top the effect of exhaust gas lapping pan walls could represent a serious noise factor.

WO9719394 discloses a boiling detection and control device based on the thermal dynamic answer to modulated heat input. This solution implies the use of an electronic device to modulate the power supply (i.e. an electronic gas valve). Furthermore the mean heat supply during heating up process is less than the maximum available, thus increasing boiling time.

U.S. Pat. No. 5,310,110 discloses a boiling detection and control device based on the evaluation of the pan bottom temperature. Food quantity and type determination is made by evaluating temperature variation during last part of heating process, near incipient boiling. This phase strongly depends on how bubbles nucleate on the water-pan interface, so that the process is regulated by a lot of uncontrollable parameters (i.e. wettability of pan surface, calcareous deposit in the water, etc.). Furthermore burning prevention means are based on pre-set empirical data.

U.S. Pat. No. 4,646,963 discloses a boiling detection and control device based on the evaluation of the pan bottom temperature. The sensor is allocated in the burner cup, with its axis offset respect to the gas nozzle. A spring and the choice of material assure good mechanical and thermal contact between the pan and the temperature sensor. This solution has the drawback that the gas burner cannot be of a standard type, in fact this solution requires a special gas burner with a hole to permit the temperature sensor presence, and this means that this type of gas burner is expensive. An additional negative point is related to the fact that with the temperature sensor assembled in the burner itself, the measured temperature is largely influenced by the flame and by the high operating temperature of the burner cup.

SUMMARY OF THE INVENTION

A main object of the present invention is to provide a cooker of the type mentioned above which does not have the above drawbacks and which is simple and economical.

A cooker in accordance with the accompanying claims overcomes such drawbacks.

The temperature detecting means is a sensor device that can monitor the thermal status of the vessel, by a contact measurement and it is placed in a zone of the cooker around the burner and it is further shielded from the influence of the burner flame. The main advantage of the present invention is to avoid any influence on the temperature sensor device caused by the burner flame, such influence being mainly due to radiation and convection.

According to a first embodiment of the invention, the temperature sensor is placed inside a seat in the grids of the cooktop, thus avoiding any expensive modification to the burner structure and using the grid as a thermal shield for the temperature sensor.

The grids are preferably of the "integral" type, i.e. are formed by the cooktop itself. They can be obtained by pressing the metal sheet forming the surface of the cooktop. The cooktop material can be glass or stainless steel or any other materials suitable for a high temperature range and for the needed structural specifications.

According to another embodiment, standard removable grids are used, with a wire or wireless connection between the temperature sensor and the heat control circuit of the cooker.

The temperature sensor can be any device reactive to pan thermal status: i.e. a thermistor or a thermocouple or thermocouple in an "open configuration". The latter is a thermocouple whose two wires are separately in contact with the pan bottom: the signal is thus proportional to the voltage drop across the two wires and the pan metal material, all of them forming an electric circuit. This easily allows using the sensor both for thermal status monitoring and for pan detection.

Being the sensor placed in an area that is directly warmed either by the cooktop material or by the pan bottom, the sensor has to be designed in such a way to be thermally insulated from the cooktop. The gas flame heats the cooktop structure: its temperature variation follows a rise depending on hob material conductance and on convective heat exchange with air. Thus it is quite independent from the heating process of the foodstuff inside the pan. More precisely, the top of the grids is influenced both by the cooktop itself and by the pan, but its thermal history follows the pan variation temperature in a filtered way, i.e. by moving away a heated pan from the cooktop, the temperature of grids decrease but with a time lag and with an unpredictable amount.

The gas exhaust effect produces high noise in the temperature signal. The grids themselves protect and shield the sensor, by deviating the hot air flows and by shielding radiation from the burner.

According to another embodiment of the invention, few ports of the burner facing the temperature sensor are occluded. This can be easily done by having a sector of the flame spreader unit of the burner without any passage for the mixture primary air/gas. This occlusion minimizes the temperature effect produced by the flame or the exhaust gases over the temperature sensor.

Even if from tests carried out by the applicant the shielding effect of the grid or of the "choked" burner is already sufficient to guarantee a reliable temperature signal to the heat control circuit, the present invention is intended to cover also a combination of a shielding grid and of a choked sector of the flame spreader unit of the burner.

BRIEF DESCRIPTION OF THE DRAWINGS

The invention will in any case, be better understood by means of the supplementary description which follows, as well as of the accompanying drawings, which supplement and drawings are, of course, given purely by way of illustrative but no-limiting example.

In the drawings.

DESCRIPTION OF THE PREFERRED EMBODIMENT

Figure 1:
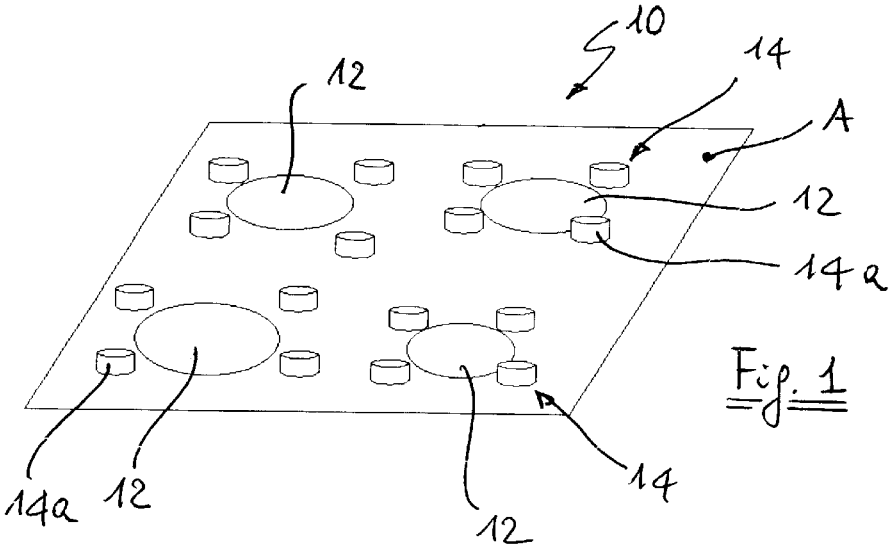
FIG. 1 is a perspective schematic view of a cooktop according to the invention.

In FIG. 1 it is shown a cooktop 10 having gas burners 12 each surrounded by a grid 14 integral with the working surface. Four bulges 14*a* protruding from the flat surface A of the cooktop 10 make each grid.

Figure 2:
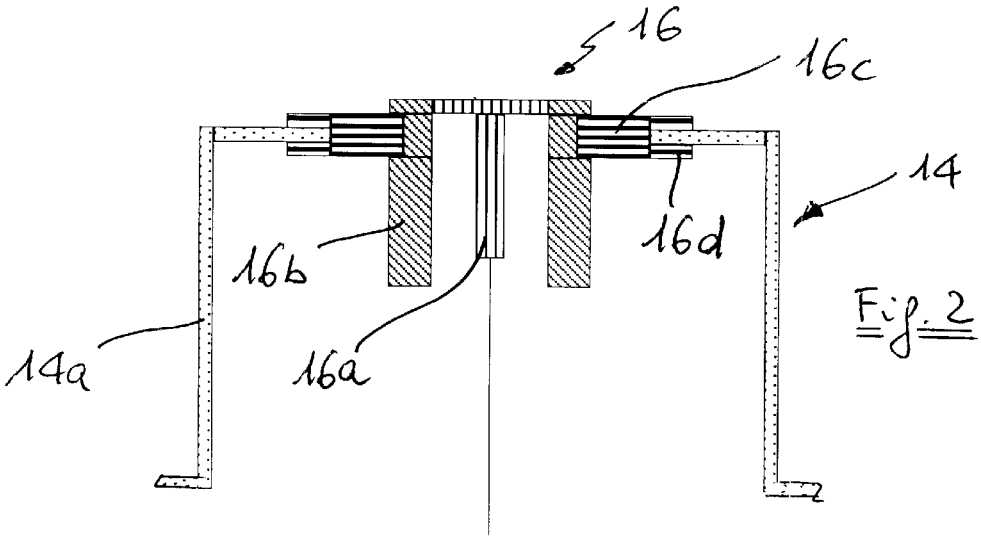
FIG. 2 is a cross-sectional view (in an enlarged scale) of a detail of FIG. 1.

In FIG. 2 a temperature sensor 16 is shown, according to a first embodiment of the invention. The sensor presents a temperature sensing probe 16*a*, a protective shield 16*b*against cooktop thermal effect and dirt (i.e. grease), an elastic gasket 16*c* in order to assure the ntact between the sensor and the pan bottom, a collar 16*d* for fixing the sensor on the grid 14*a*.

The temperature-sensing probe 16*a* is put in the inner part of the device. Its upper part is a flat disk-shaped surface made with a high conductive material. The dimensions of this disk are quite large to assure a good contact with the pan (diameter of the disk), but at the same time enough small in order to avoid any thermal drift due to the mass of the disk itself.

The disk is in thermal/electrical contact with the temperature sensor (i.e. thermocouple standard or open thermocouple or thermistor or any thermal status sensor).

The disk is connected with a cylinder 16*b* made of a low conductance material. The connection can be realized by welding or gluing or mechanical joint.

The air gap between the two parts protects the sensor from the heating by the grid 14 and by the working plate A of the cooktop.

The connection of the protective cylinder 16*b* to the grid 14*a* is preferably made by means of an elastic gasket 16*c*. This solution offers two advantages:

it seals the device against dirt and heat;

it allows a flexible support to the sensor, in order to have a good thermal contact with the pan bottom.

The gasket 16*c* has a particular shape to completely seal the gap between the cylinder 16*b* and the grid 14*a*, to be securely fixed to the grid and to support the temperature sensor. The disk of the sensor is placed above the height of the grid, so to be always in contact with the pan. Due to the elastic properties of the gasket 16*c* the weight of the pan is enough to press the gasket itself so that the pan bottom touches all the grids top surface and there aren't any problems of pan instability.

Figure 3:
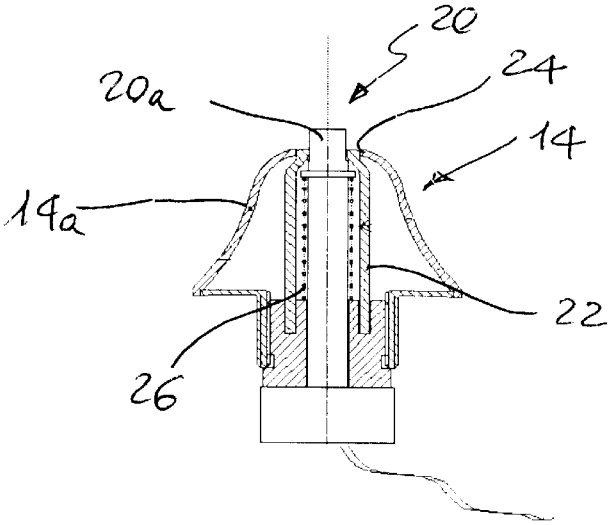
FIG. 3 is a cross-sectional view similar to FIG. 2, but according to a second embodiment of the invention.
Figure 4:
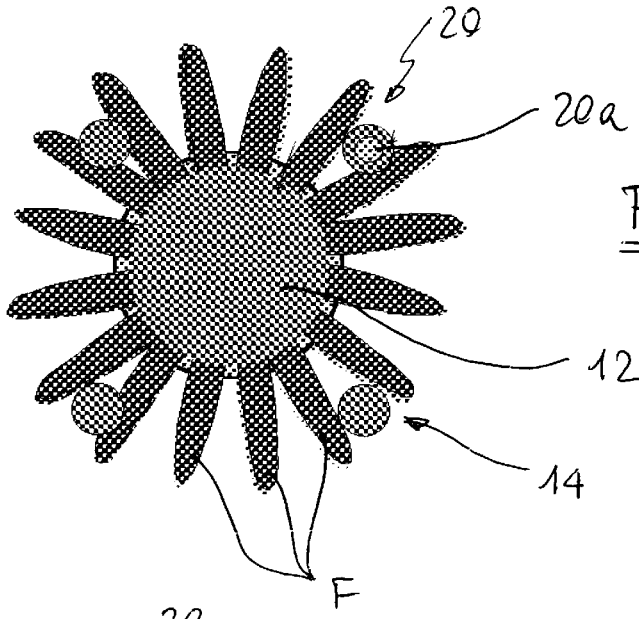
FIG. 4 is a top view of a gas burner in which the integral grid of FIGS. 1 and 3 is used.

According to a second embodiment (FIG. 3), the temperature sensor 20 is slidably mounted in an insulating tubular body 22 so that its upper end 20*a* protrudes from an aperture 24 provided in the top portion of the bulge 14*a*. The upper end 20*a* is maintained in such position by a spring 26 which, in the working condition of the cooker, urges the end 20*a* against the bottom of a pan. The tubular insulating body 22 is coaxial with the bulge 14*a* so that a hollow space is defined therebetween. This hollow space increases the thermal insulating effect of the tubular body 22. In this embodiment it is advantageous to have the bulge 14*a* with the temperature sensor removable from the working surface of the cooktop 10. In this case the removable bulge 14*a* can be mounted on the cooktop. Of course the bulge 14*a* can be fixed to the cooktop, i.e. by welding or gluing or mechanical joint.

Figure 5:
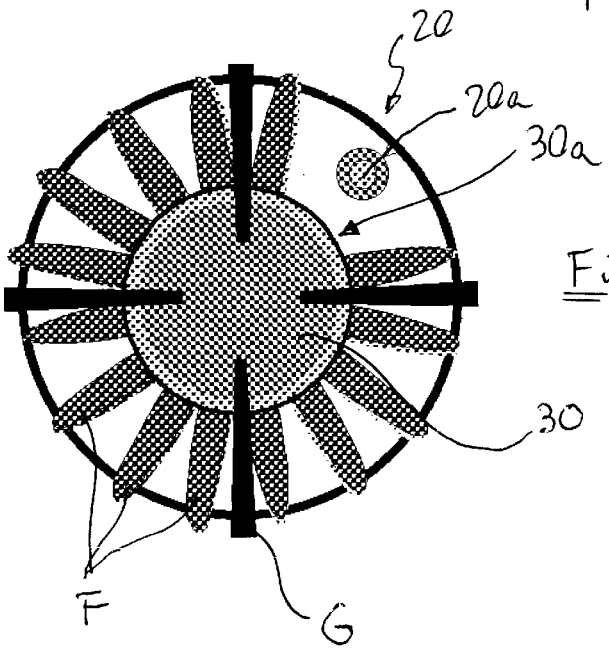
FIG. 5 is a top view of a cooker according to a third embodiment of the invention, in which the flame spreader unit is shielded in a zone in front of the temperature
Figure 6:
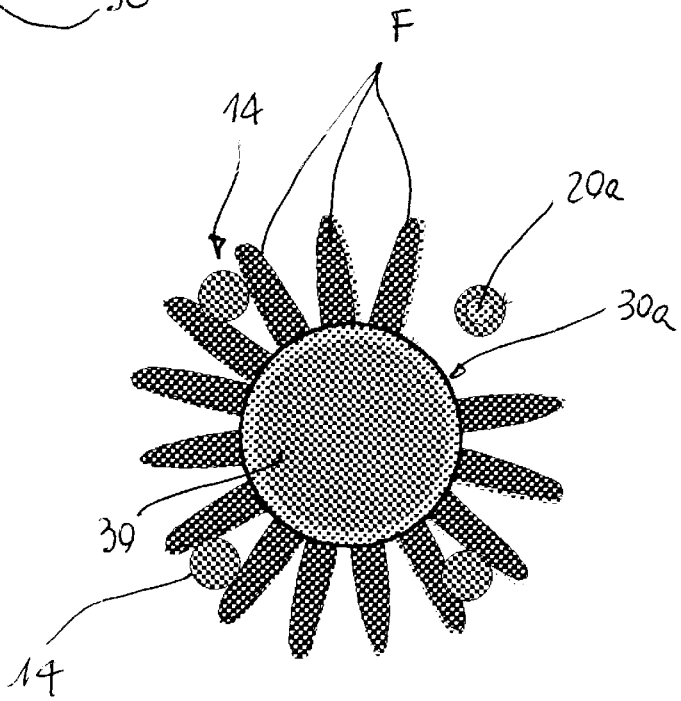
FIG. 6 is a top view similar to FIG. 5 in which both the embodiments of FIGS. 4 and 5 are combined together.

In FIGS. 5 and 6 it is shown a further embodiment of the invention in which the burner has a flame spreader unit 30 partially occluded in a sector 30*a* thereof. In these figures burner flames are schematically indicated with the reference F. According to the technical solution shown in FIG. 5, the cooktop presents, for each burner, only one bulge 14 that is used for the purpose of housing the temperature sensor. For supporting the pan, a usual removable grid G is used. The bulge 14 of FIGS. 5 and 6, i.e. the thermally shielded bulge containing the temperature sensor, is placed substantially in front of the sector 30*a* of the flame spreader unit 30. In FIG. 6 an "integral" grid is used, in combination with the partially occluded flame spreader unit 30. This solution guarantees the best shielding effect and the most reliable temperature detection.

In the following it will be described how the heat control circuit according to the invention works.

During the heating process of a pan full of water with a constant rate of power supply, there are 4 phases (see FIGS. 9–10):

heating up of the pan bottom heating up of the food content sub-boiling full boiling The heating up of the pan bottom (phase 1 in FIG. 10) is a very short phase (from few seconds up to some minutes), in which most of the heat supplied by the flame acts to vary the caloric content of the pan. Water enthalpy, and thus its temperature, does not vary. The temperature rise is very rapid and depends on physical property of the pan material (thermal conductance, specific heat) and on heat flow from the gas flame.

Assuming a good thermal conductance, as it is in most of the vessels sold on the market, the average temperature of pan bottom varies as following:

$$\text{grad}T_{pan}=Q_{flame}/(C_p{}^*\rho^*V)_{pan}$$

where: $T_{pan}$ temperature of pan bottom, $C_{p,pan}$ specific heat of the pan, $\rho_{pan}$ pan density, $V_{pan}$ pan bottom volume, $Q_{flame}$ burner heat power.

Figure 9:
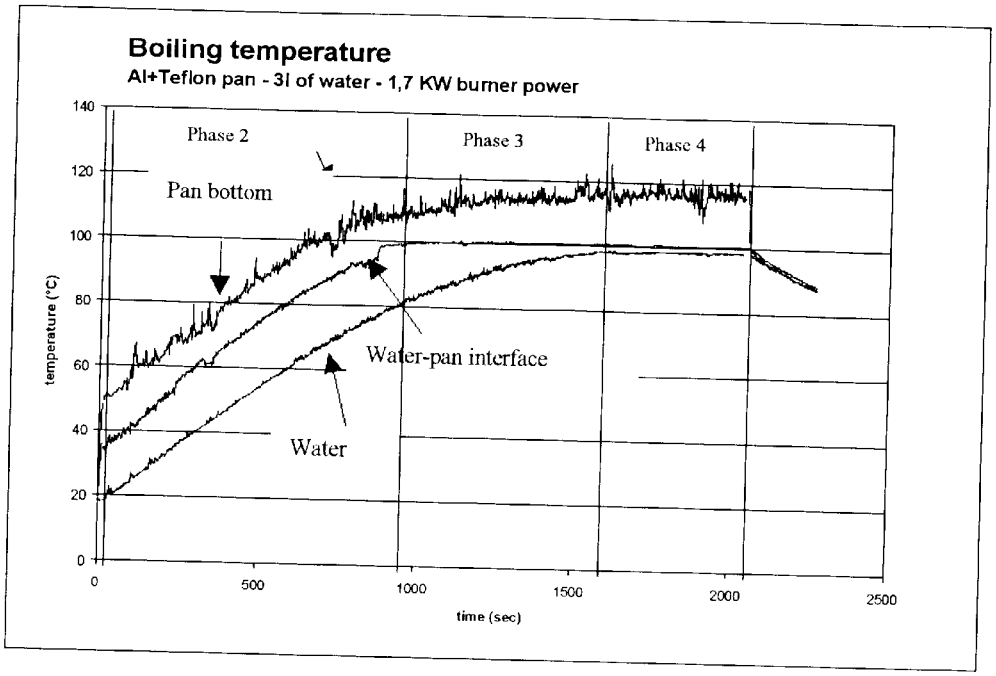
FIGS. 9–10 are diagrams showing the temperature profiles either of the container or of the water contained therein during a typical heating/cooking process.
Figure 10:
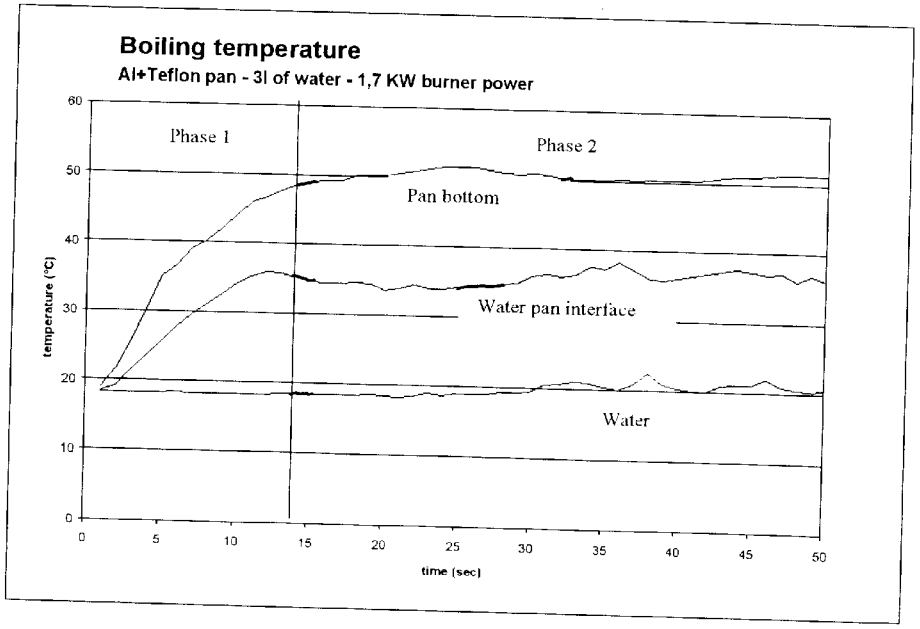

In the subsequent step (heating up of the food content), there is heat flow from pan to water (phase 2 in FIGS. 9 and 10). Assuming a good thermal conductance for the water content (this can be accepted as true since a little temperature gradient is sufficient to create convective flows that mix different temperature water layers), the average temperature of pan bottom varies as following:

$$\text{Grad}T_{water}=Q_{pan}/(C_p{}^*\rho^*V)_{water}$$

where: $T_{water}$ average temperature of water, $C_p$ water water specific heat, $\rho_{water}$ water density, $V_{water}$ water volume, $Q_{pan}$ heat power from pan to water.

While for pan bottom temperature, measured at the interface in contact with the grids, we have:

$$T_{pan}=T_{water}+(Q_{flame}-Q_{pan})^*(L/K_{pan}{}^*A))$$

where: $L_{pan}$ pan bottom thickness $A_{pan}$ pan bottom area, $K_{pan}$ pan bottom thermal conductance.

Thus the temperature of the water and the pan bottom vary at the same rate.

The temperature gradient depends mainly on the property of water (mass and specific heat) and on the heat flow from the gas flame.

In the sub-boiling phase (phase 3 in FIG. 9), boiling conditions are reached at the water-pan bottom interface: this means that at constant pressure condition (as it happens in vessel without "pressure lid") temperature remains constant.

Often this step is identified with the growth of steam bubbles at the pan bottom surface. The nucleating sites are those with some irregularities in the flat pan surface (i.e. calcareous deposit or grooves). As the nucleating process strictly depends on the pan wettability, the bubbles growth can start even at lower temperature (i.e. with Teflon pan). Temperatures of water and pan can vary in different ways, depending mainly on pan surface properties.

In the full-boiling phase (phase 4 in FIG. 9) all water starts to boil: at constant pressure condition (as it happens in vessel without "pressure lid") water temperature remains constant.

In most cases steam bubbles reaches the free water interface (air-water) where they collapse, producing noise. In some cases, the heat flow rate is not enough to produce such a visible and acoustic phenomenon (this can happens with a large amount of water heated at low burner power).

In any case, temperatures of both water and pan stay constant.

The heat control circuit works according to a control algorithm that is in line with the above physical phenomena.

Figure 7:
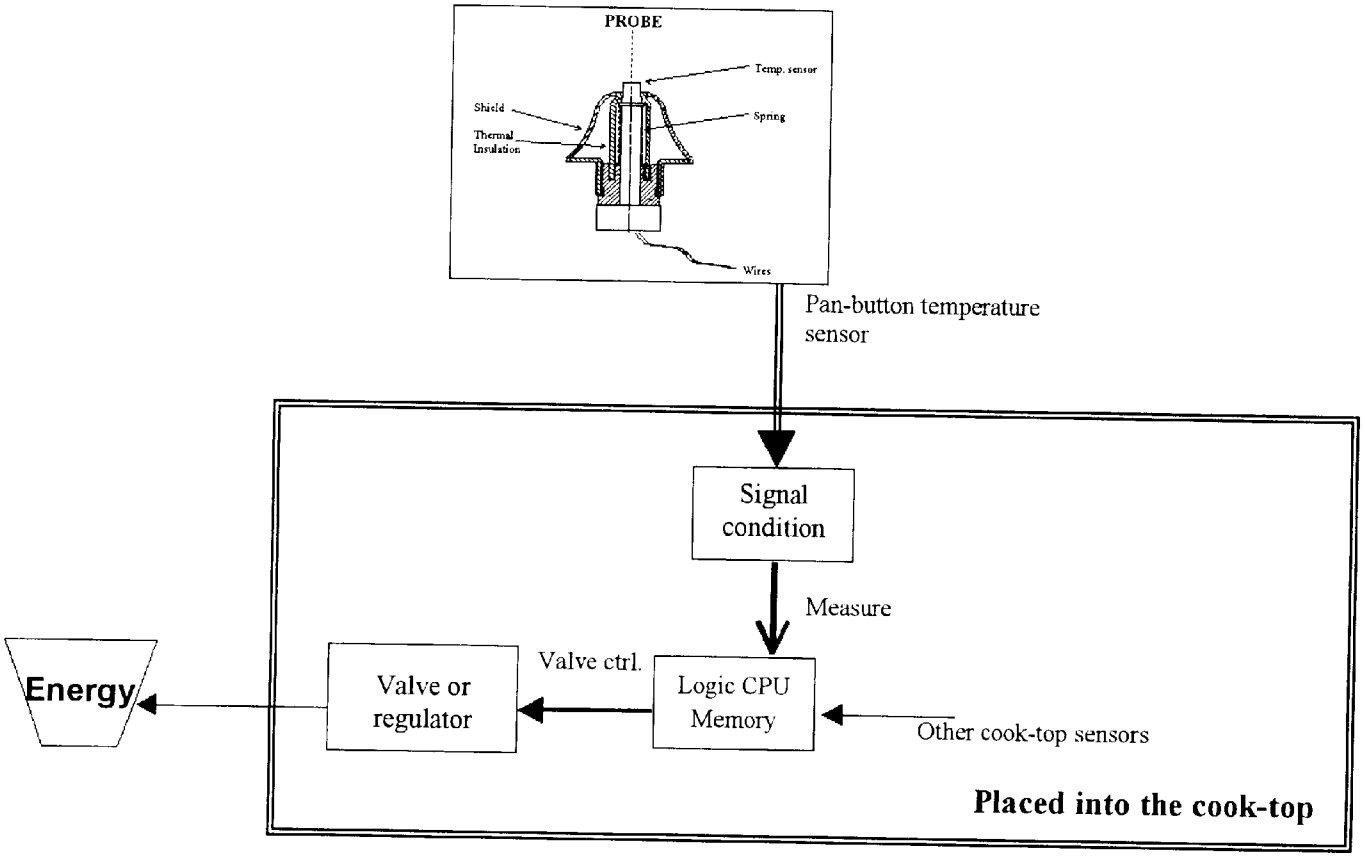
FIG. 7 is a block diagram showing how the heat control circuit is working.
Figure 8:
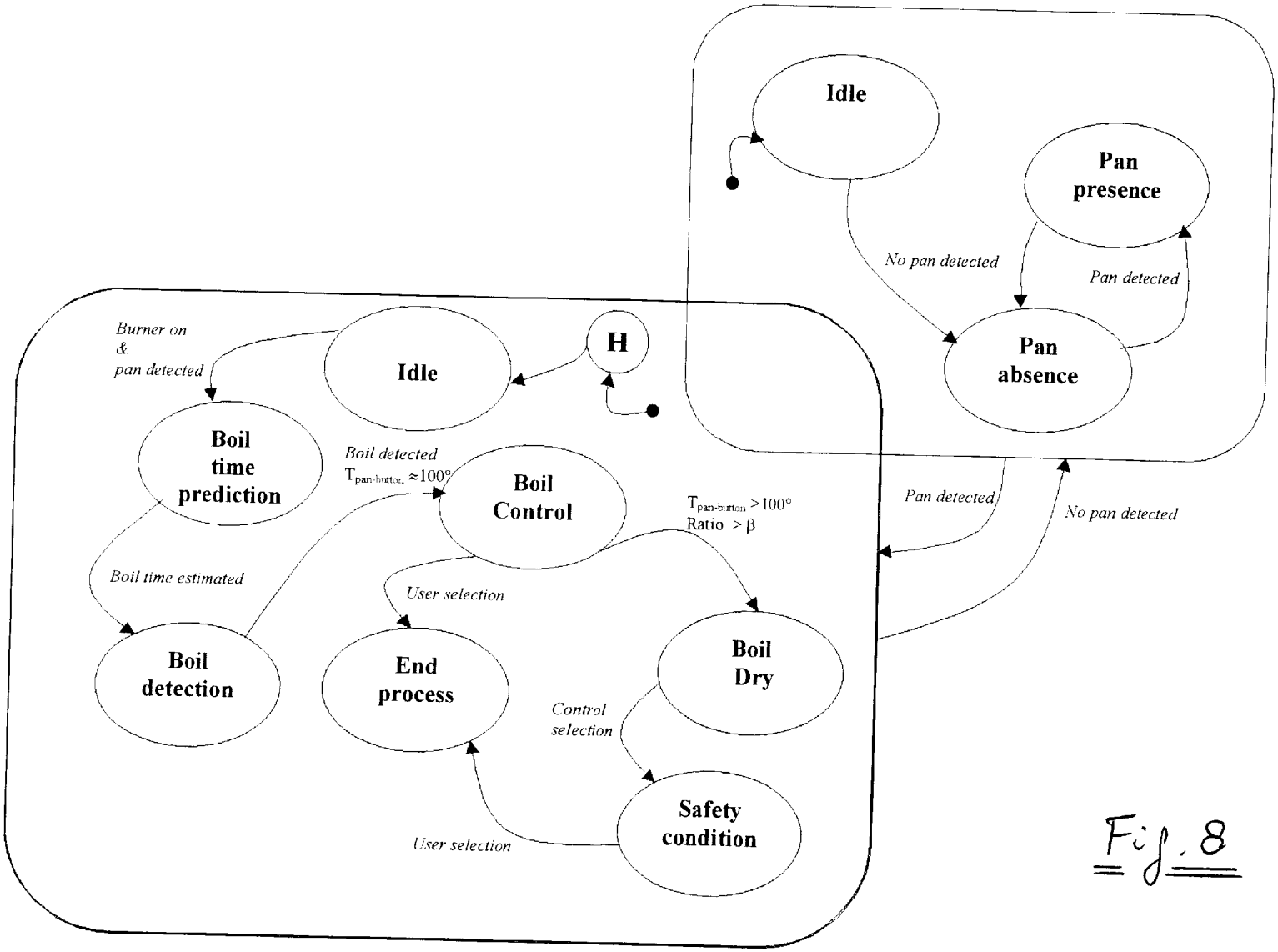
FIG. 8 is a state-chart showing the hybrid control behavior and sub-task states thereof.

The aim of the control algorithm is manly to decide the correct energy flow to perform the selected function by monitoring the temperature. The energy flow may be changed using an energy regulator or a regulation valve (FIG. 7). Based on a defined sampling time the control circuit acquires the temperature measure. This information, after digital filter phase, is passed to a hybrid digital control. The hybrid control behavior follows sub-task states as described with state-chart formalism in FIG. 8. A first step, called as "boil time prediction phase" starts immediately after the burner switches on (in phase 1 above), and during the next few seconds the control circuit estimates the water load into the pot and, by this information and the initial temperature, it estimates the time necessary to reach the boiling phase. This information will be outputted into the user interface.

In a second phase, defined as "boil detection phase", the boiling instant is detected by monitoring the pan-button temperature sensor trend, compensating eventually the cover presence/absence and adjusting the prediction during increasing temperature. The boil detection point is now confirmed and/or adjusted by measuring the pan-button temperature and its derivative value.

In a third phase, defined as "boil control phase", the temperature variation feedback is negligible, meaning that a pure temperature control to keep a "visual" boiling phase may be difficult. By using the previously estimated water load and system efficiency estimation, the control circuit evaluates the needed energy to maintain the water temperature and boil process according with user preference. The closed loop behavior is anyway based on controlling the pan-button temperature shape around the double-phase (liquid-vapor) condition.

If the water content in the pan is reduced to zero, a fourth phase can be present, called "boil dry phase": by monitoring the temperature shape and the increase ratio the control circuit redicts the water absence.

By monitoring the pan-bottom temperature variation during a reduced period of time (few seconds), the control circuit is able to detect the pan presence/absence.

We claim:

1. A cooker comprising a gas burner for heating food material in a container, temperature detection means for detecting the temperature of the bottom face of the container and issuing a temperature signal, heat control circuit for controlling the amount of heat issued from the gas burner based on said temperature signal, wherein the temperature detection means is placed in a zone of the cooker around the burner and in that shielding means are provided in order to reduce the influence of the burner flame on the temperature detection means.

2. A cooker according to claim 1, in which a grid is used for supporting the container, wherein the shielding means comprise a portion of the grid in which temperature detection means is placed.

3. A cooker according to claim 2, in which the grid is integral with the worktop of the cooker and comprises bulges protruding from the worktop, wherein the temperature detection means is placed in one of said bulges, the wall of the bulge defining said shielding means.

4. A cooker according to claim 3, wherein the temperature detection means comprises a temperature sensor having an upper disk-shaped portion adapted to be put in contact with the container, such portion and the remaining portion of the temperature sensor being contained in an insulating tubular body substantially coaxial with the bulge.

5. A cooker according to claim 3, wherein the temperature detection means comprises a temperature sensor protruding from the top of the bulge and adapted to be elastically biased against the bottom of the container, such sensor being slidably contained in an insulating tubular body substantially coaxial with the bulge so that an insulating hollow space is defined between the bulge wall and such tubular body.

6. A cooker according to claim 1, wherein the shielding means comprises a sector of a round flame spreader unit of the burner in which flames are prevented, such sector being substantially in front of the temperature detection means.

7. A cooker according to claim 6, wherein the heat control circuit is able to detect the temperature gradient in a first heating phase, from this temperature gradient the heating control circuit being able to estimate the time necessary to reach boiling based on estimated amount of food material and to use the estimated time value for a more reliable control of the heating/cooking process.

8. A cooker according to claim 7, wherein the heating control circuit is able to use the estimated food material quantity for evaluating the energy needed to maintain the boiling condition without any energy waste.

9. A cooker according to claim 7, wherein the heating control circuit is able to detect the presence/absence of the container by monitoring the temperature variation of the bottom of the container for a predetermined period of time.

* * * * *